US007383894B2

(12) United States Patent
Chen et al.

(10) Patent No.: US 7,383,894 B2
(45) Date of Patent: Jun. 10, 2008

(54) PNEUMATIC HAMMER DRILL (I)

(75) Inventors: Chun-Hao Chen, Taichung Hsien (TW); Yueh-Pei Liu, Taichung Hsien (TW)

(73) Assignee: Shun Tai Precision Co., Ltd., Taichung Hsien (TW)

( * ) Notice: Subject to any disclaimer, the term of this patent is extended or adjusted under 35 U.S.C. 154(b) by 0 days.

(21) Appl. No.: 11/430,956

(22) Filed: May 10, 2006

(65) Prior Publication Data

US 2007/0158087 A1 Jul. 12, 2007

(30) Foreign Application Priority Data

Jan. 10, 2006 (TW) ..... 95200529 U

(51) Int. Cl.
*B25D 17/00* (2006.01)

(52) U.S. Cl. ..... 173/162.1; 173/162.2

(58) Field of Classification Search ..... 173/162.1, 173/162.2, 91, 135, 137; 91/296, 317
See application file for complete search history.

(56) References Cited

U.S. PATENT DOCUMENTS 1,126,096 A * 1/1915 Schmidt ..... 173/18
1,796,389 A * 3/1931 Nell ..... 91/239
2,312,367 A * 3/1943 Gartin ..... 91/236
3,651,874 A * 3/1972 Sudnishnikov et al. ..... 173/91
4,078,619 A * 3/1978 Sudnishnikov et al. ..... 175/19
4,283,991 A * 8/1981 Gaun et al. ..... 91/299
4,850,437 A * 7/1989 Sudnishnikov et al. ..... 173/13
5,113,950 A * 5/1992 Krasnoff ..... 173/13

OTHER PUBLICATIONS

U.S. Appl. No. 11/552,325, filed Oct. 24, 2006.
U.S. Appl. No. 11/436,587, filed May 19, 2006.

* cited by examiner

*Primary Examiner*—Rinaldi I. Rida
*Assistant Examiner*—Nathaniel Chukwurah
(74) *Attorney, Agent, or Firm*—Fitzpatrick, Cella, Harper & Scinto

(57) ABSTRACT

A pneumatic hammer drill includes: a pneumatic cylinder having a cylinder rear end fitted in a handle body, an air passage, and a pressure chamber; and an air valve adjacent to the cylinder rear end. The air valve has a front bearing end, a valve orifice interconnecting fluidly the air passage and the pressure chamber, and an opening disposed at the front bearing end in communication with the valve orifice. A piston is disposed slidably in the pressure chamber, and has a piston rear end capable of moving towards or away from the front bearing end. An air trap arrangement is associated with the piston rear end and the front bearing end to trap air between the same and around the opening so as to provide a shock-absorbing air cushion when the piston rear end moves towards the front bearing end.

4 Claims, 10 Drawing Sheets

PNEUMATIC HAMMER DRILL (I)

CROSS-REFERENCE TO RELATED APPLICATION

This application claims priority of Taiwanese Application No. 095200529, filed on Jan. 10, 2006.

BACKGROUND OF THE INVENTION

1. Field of the Invention

The invention relates to a pneumatic hand tool, more particularly to a pneumatic hammer drill.

2. Description of the Related Art

Referring to FIGS. 1 and 2, a conventional pneumatic hammer drill includes a handle body 10, a pneumatic cylinder 12, an air valve 13, and a tool 14. The handle body 10 defines a cavity 111 at an upper portion thereof, and has a lower handgrip portion 11. The pneumatic cylinder 12 is fitted into the cavity 111, and includes an externally threaded front end 1213 extending outwardly from the cavity 111, a spring element 122 engaged threadedly to the front end 1213, a pressure chamber 1211, a piston 123 inserted slidably into the pressure chamber 1211, and an air passage 1212 in fluid communication with the pressure chamber 1211 and the air valve 13. Highly compressed air is introduced into the air passage 1212 via the lower handgrip portion 11. The spring element 122 has a limiting end 1221 extending outwardly and curvedly from a front end thereof.

The air valve 13 is disposed in the cavity 111 adjacent to the pneumatic cylinder 12, and includes a front valve casing 131, a rear valve casing 132, a diaphragm 133, and a plurality of positioning pins 134. The front valve casing 131 is provided with a valve orifice 1311 to permit air flow therethrough, and a plurality of positioning holes 1312 around the valve orifice 1311. The rear valve casing 132 is provided with a valve orifice 1323, a valve seat 1321 disposed around the valve orifice 1323 and receiving the diaphragm 133 therein, and a plurality of fixing holes 1322 around the valve seat 1321. The positioning pins 134 interconnect the front and rear valve casings 131, 132, and have front ends inserted respectively into the positioning holes 1312 in the front valve casing 131, and rear ends inserted correspondingly into the fixing holes 1322 in the rear valve casing 132, thereby aligning the holes 1312, 1322 in the front and rear valve casings 131, 132.

The tool 14 has an annular protrusion 142 proximate to a rear portion 141 thereof and located between a front end face of the pneumatic cylinder 12 and the limiting end 1221 of the spring element 122.

The compressed air flows through the valve orifices 1311, 1323 from the air passage 1212 in the pneumatic cylinder 12, and enters a rear side of the pressure chamber 1211 so as to push forwardly the piston 123, which in turn, strikes the tool 14 so that the tool 14 produces a hammering force on a workpiece. The tool 14 cannot be released from the pneumatic cylinder 12 as the annular protrusion 142 thereof is engaged with the limiting end 1221 of the spring element 122. When the compressed air enters a front side of the pressure chamber 1211 via the air passage 1212, the piston 123 is pushed rearwardly toward the front valve casing 131 so that the tool 14 is restored to its original position through a restoring force of the spring element 122. Hence, by moving the piston 123 reciprocatingly in the pressure chamber 1211 through such supply of the compressed air, a hammering action of the tool 14 is effected.

Although the aforementioned conventional pneumatic hammer drill can achieve its intended purpose, it has many drawbacks. Firstly, since a front end face of the front valve casing 131 and a rear end face of the piston 123 are generally flat, and since the impact of the piston 123 against the front valve casing 131 is strong when the compressed air pushes the piston 123 rearwardly toward the front valve casing 131, internal components of the hammer drill are prone to damage over time. Further, because of the strong impact force, an operator's hand is easily fatigued and may even become injured. Moreover, the strong impact produces a loud noise which is unpleasant and may even adversely affect the sense of hearing of the operator. Additionally, the positioning holes 1312 in the front valve casing 131 must be aligned with the fixing holes 1322 in the rear valve casing 132 and at the same time with the air passage 1212 in the pneumatic cylinder 12 so as to permit air flow into the air valve 13. However, since such alignment is not easily achieved, overall assembly of the conventional hammer drill is made complicated.

SUMMARY OF THE INVENTION

Therefore, the object of the present invention is to provide a pneumatic hammer drill that can reduce an impact force, that has a good damping effect, and that is relatively easy to assemble.

According to this invention, a pneumatic hammer drill comprises a handle body, a pneumatic cylinder, an air valve, a piston, and an air trap arrangement. The pneumatic cylinder has a cylinder rear end fitted in the handle body, a front tool-connecting end, an air passage, and a pressure chamber. The air valve is fitted in the handle body adjacent to the cylinder rear end, and has a front bearing end, a valve orifice interconnecting fluidly the air passage and the pressure chamber, an opening disposed at the front bearing end in communication with the valve orifice, and a diaphragm disposed across the valve orifice. The piston is disposed slidably in the pressure chamber, and has a piston rear end capable of moving towards or away from the front bearing end. The air trap arrangement is associated with the piston rear end and the front bearing end to trap air between the piston rear end and the front bearing end and around the opening so as to provide a shock-absorbing air cushion when the piston rear end moves towards the front bearing end. The air trap arrangement includes a protrusion formed in one of the front bearing end and the piston rear end, and a cavity formed in the other one of the front bearing end and the piston rear end to receive the protrusion. The protrusion has a cross section smaller than that of the cavity.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
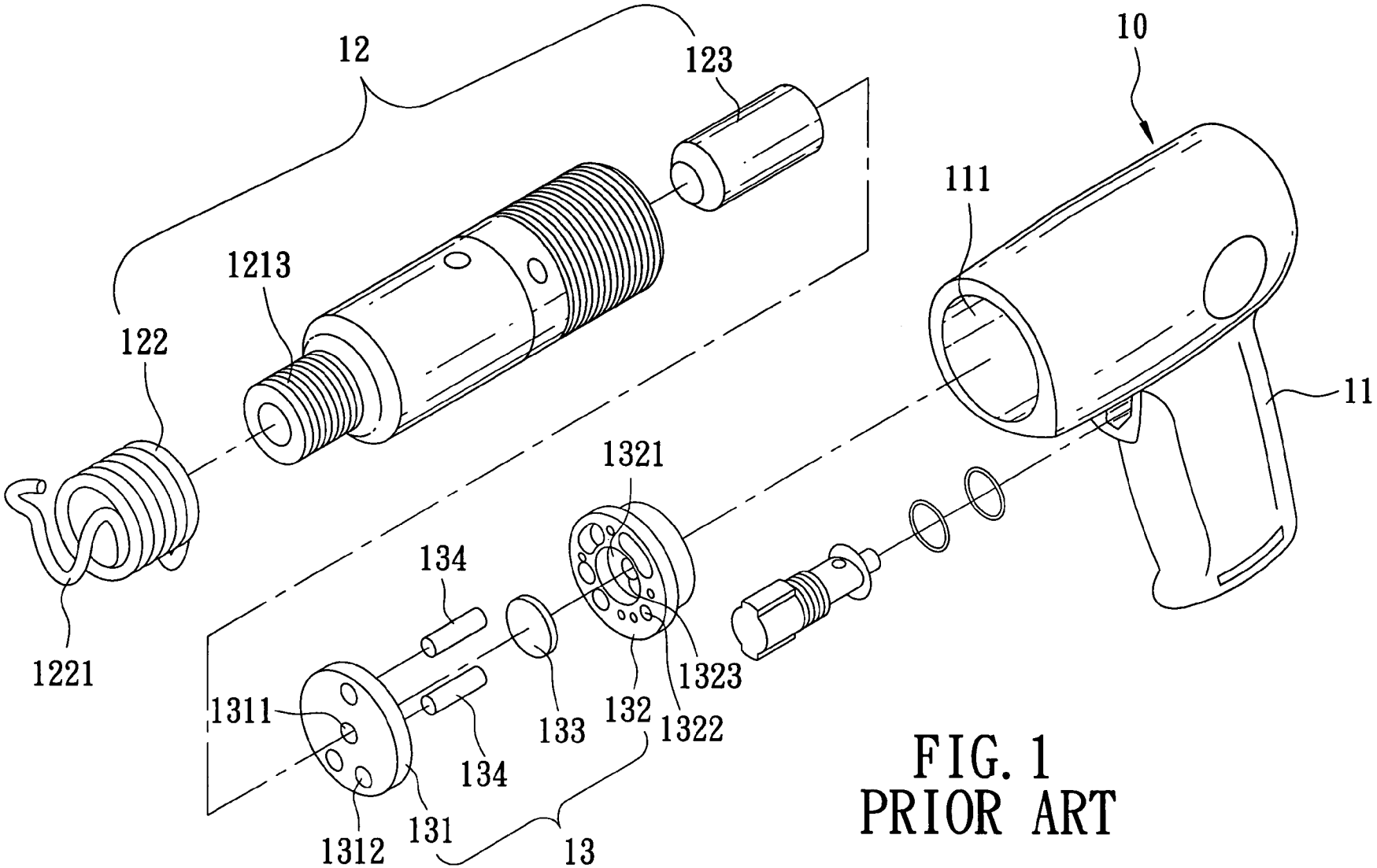
FIG. 1 PRIOR ART
FIG. 1 is an exploded perspective view of a conventional pneumatic hammer drill.
Figure 2:
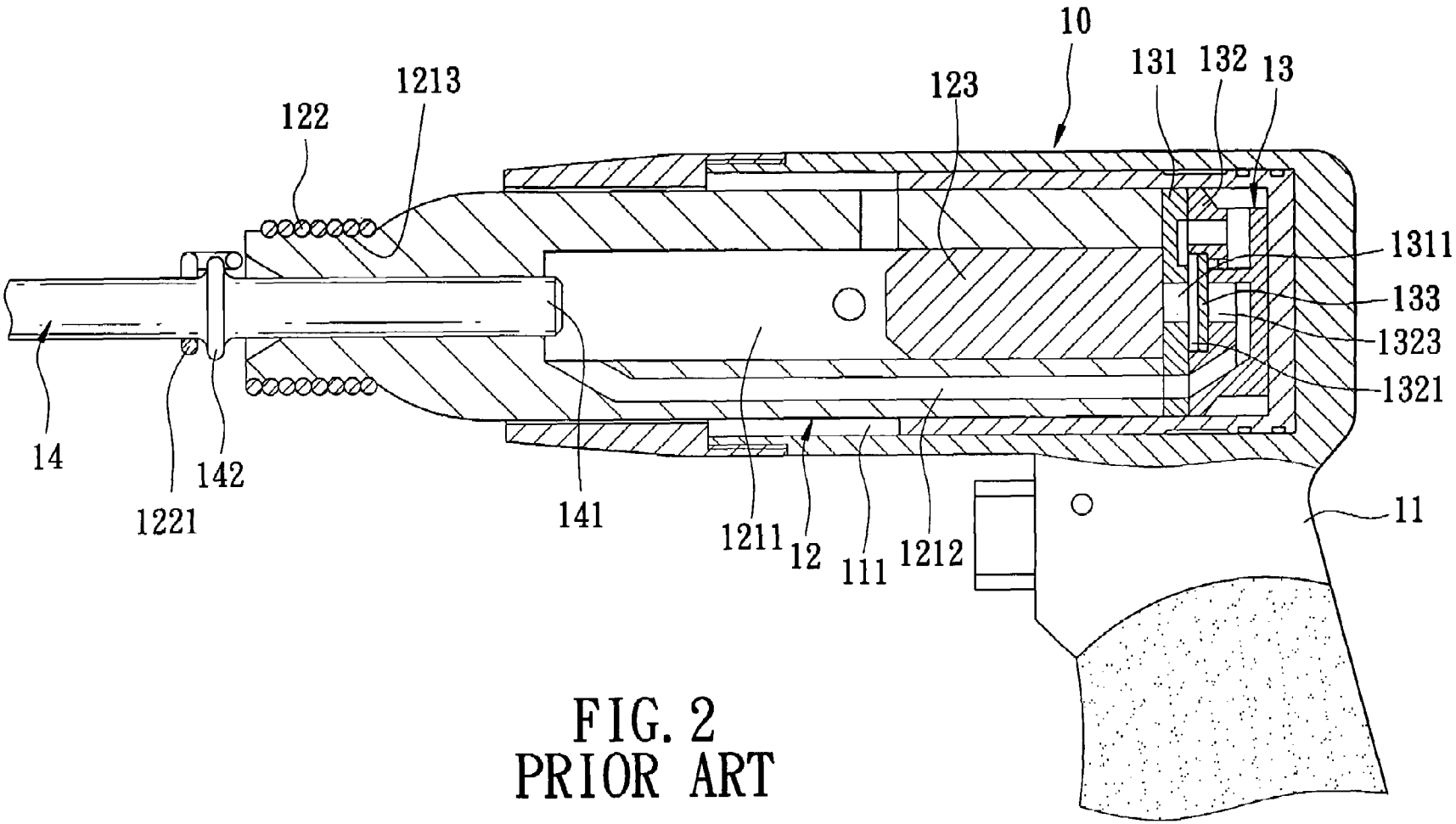
FIG. 2 PRIOR ART
FIG. 2 is a fragmentary sectional view of the conventional pneumatic hammer drill in an assembled state.
Figure 3:
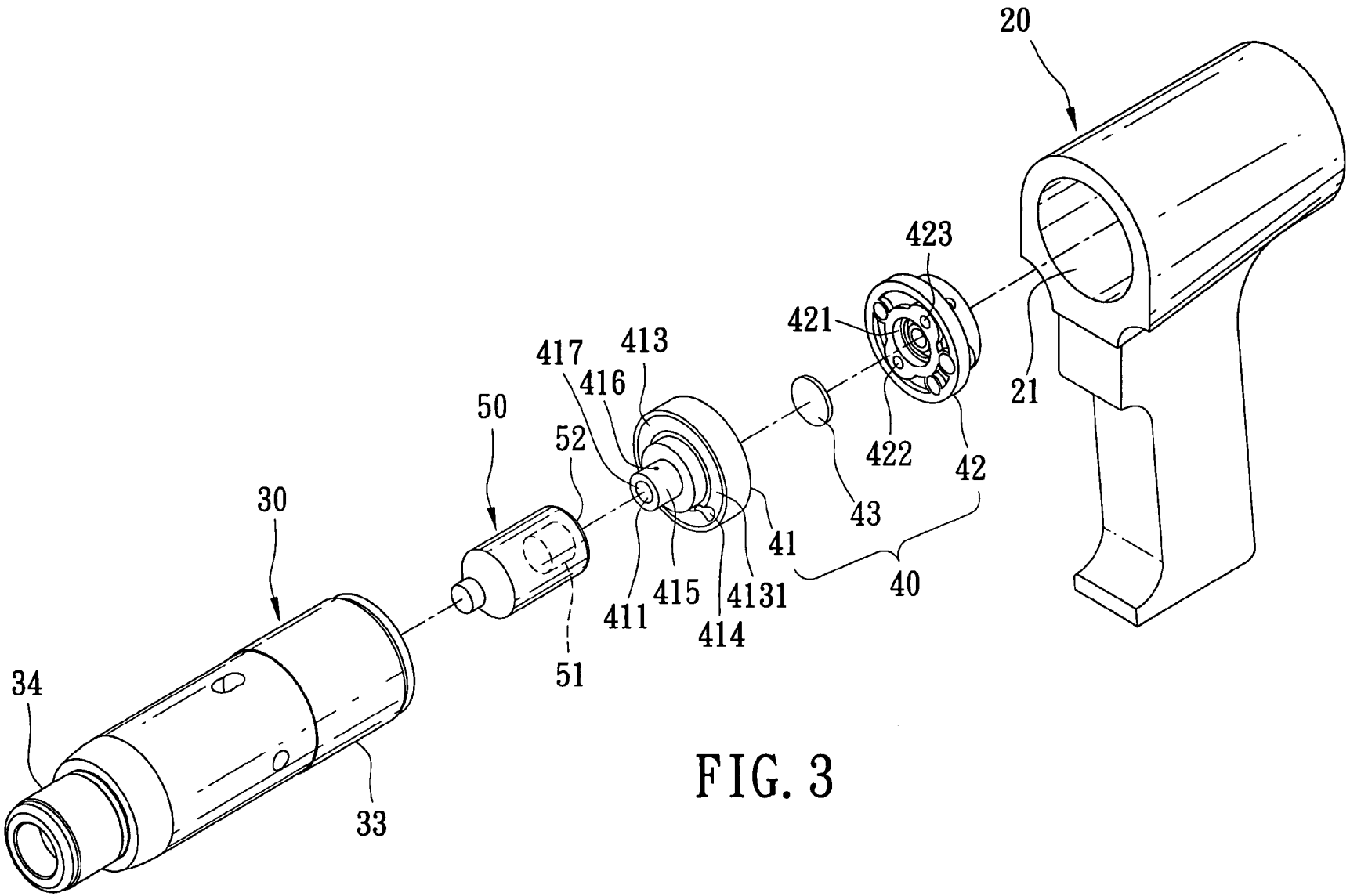
FIG. 3 is an exploded perspective view of the first preferred embodiment of a pneumatic hammer drill according to the present invention.

Before the present invention is described in greater detail, it should be noted that like elements are denoted by the same reference numerals throughout the disclosure.

Referring to FIGS. 3 to 7, the first preferred embodiment of a pneumatic hammer drill according to the present invention is shown to comprise a handle body 20, a pneumatic cylinder 30, an air valve 40, a piston 50, and an air trap arrangement.

The handle body 20 defines a receiving space 21 at a top portion thereof. An air supply unit (not shown) is connected to a bottom end of the handle body 20 so as to introduce compressed air into the handle body 20.

The pneumatic cylinder 30 has a cylinder rear end 33 fitted in the receiving space 21, and a front tool-connecting end 34 extending outwardly of the receiving space 21 and adapted to connect with a tool 100, such as a chisel. The pneumatic cylinder 30 is provided with a pressure chamber 31, and an air passage 32.

The air valve 40 is fitted in the receiving space 21 of the handle body 20 adjacent to the pneumatic cylinder 30, and has a front bearing end 413, a valve orifice 411 that interconnects fluidly the air passage 32 and the pressure chamber 31, an opening 417 disposed at the front bearing end 413 in communication with the valve orifice 411, and a diaphragm 43 disposed across the valve orifice 411. The air valve 40 includes a front valve casing 41 adjacent to the cylinder rear end 33 of the pneumatic cylinder 30, and a rear valve casing 42 abutting against the front valve casing 41. The front valve casing 41 is provided with the front bearing end 413. The front bearing end 413 has an annular groove 4131 formed therein, and an aperture 414 formed in the annular groove 4131 in fluid communication with the rear valve casing 42 and alignable with the air passage 32. The valve orifice 411 has a section 4111 extending in the front valve casing 41, and another section 4112 extending in the rear valve casing 42. The rear valve casing 42 has a valve seat 421 around the section 4112 of the valve orifice 411, and an air inlet 422 and an air outlet 423 disposed respectively on two opposite sides of the valve seat 421. The air inlet 422 and the air outlet 423 are communicated fluidly to the section 4112. The diaphragm 43 is disposed in the valve seat 421.

The piston 50 is disposed slidably in the pressure chamber 31 of the pneumatic cylinder 30, and has a piston rear end 52 capable of moving towards or away from the front bearing end 413 of the air valve 40.

The air trap arrangement is associated with the piston rear end 52 of the piston 50 and the front bearing end 413 of the air valve 40 to trap air between the piston rear end 52 and the front bearing end 413 and around the opening 417 so as to provide a shock-absorbing air cushion when the piston rear end 52 moves towards the front bearing end 413. In this embodiment, the air trap arrangement includes a protrusion 415 formed in the front bearing end 413, and a cavity 51 formed in the piston rear end 52 to receive the protrusion 415. The protrusion 415 has a tubular wall around the valve orifice 411, and is formed with two diametrically opposed radial holes 416 in fluid communication with the valve orifice 411. The protrusion 415 has a cross section smaller than that of the cavity 51 so that a gap (I) (see FIG. 7) is formed in the cavity 51 around the protrusion 415.

In operation, compressed air enters the handle body 20, flows from the air passage 32 to the air valve 40, pushes the diaphragm 43 via the air inlet 422, and enters a rear side of the pressure chamber 31 via the valve orifice 411 so as to push the piston 50 forwardly. The piston 50, in turn, strikes the tool 100 to displace the same forwardly.

Figure 4:
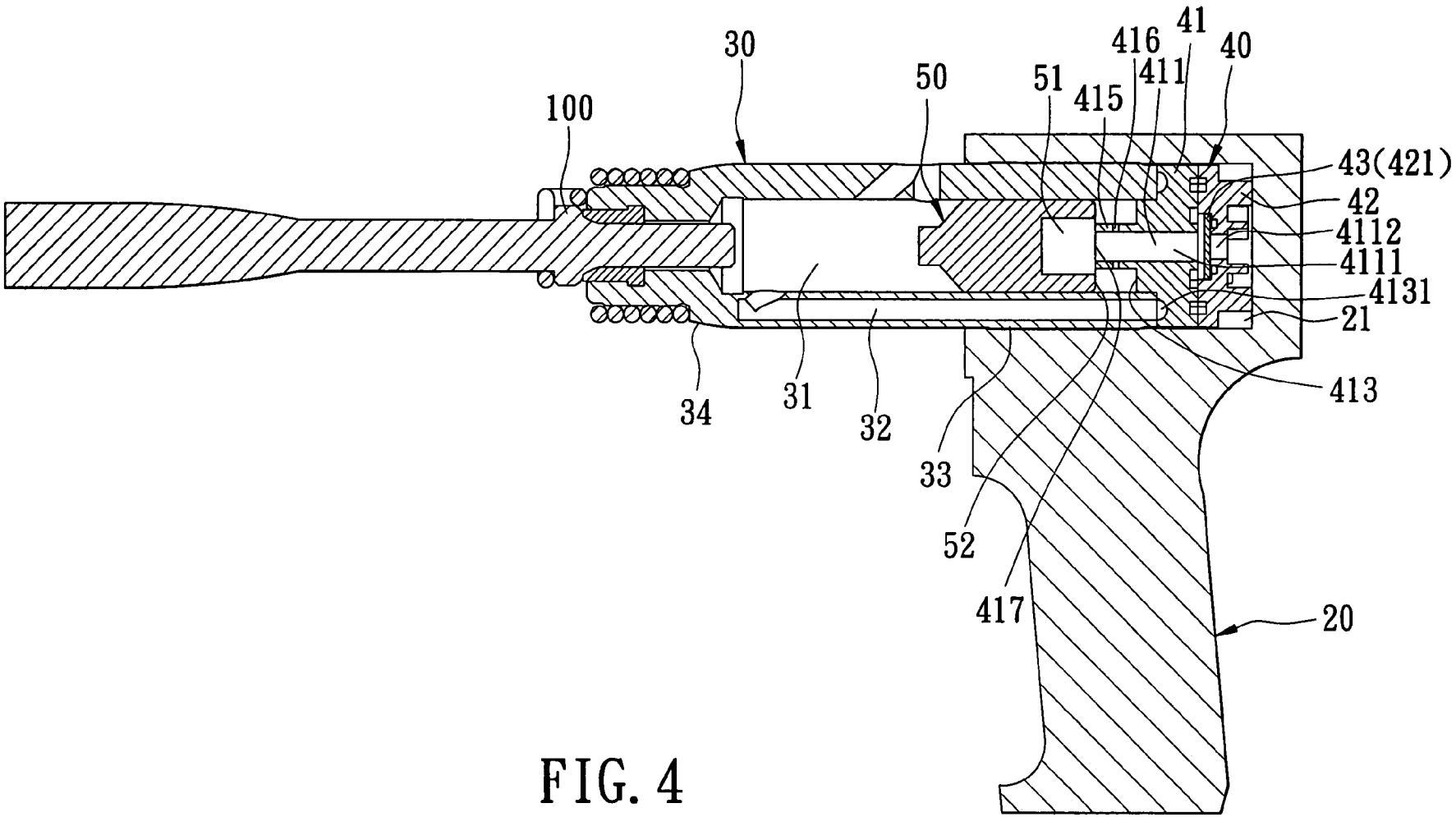
FIG. 4 is an assembled sectional view of the first preferred embodiment.
Figure 5:
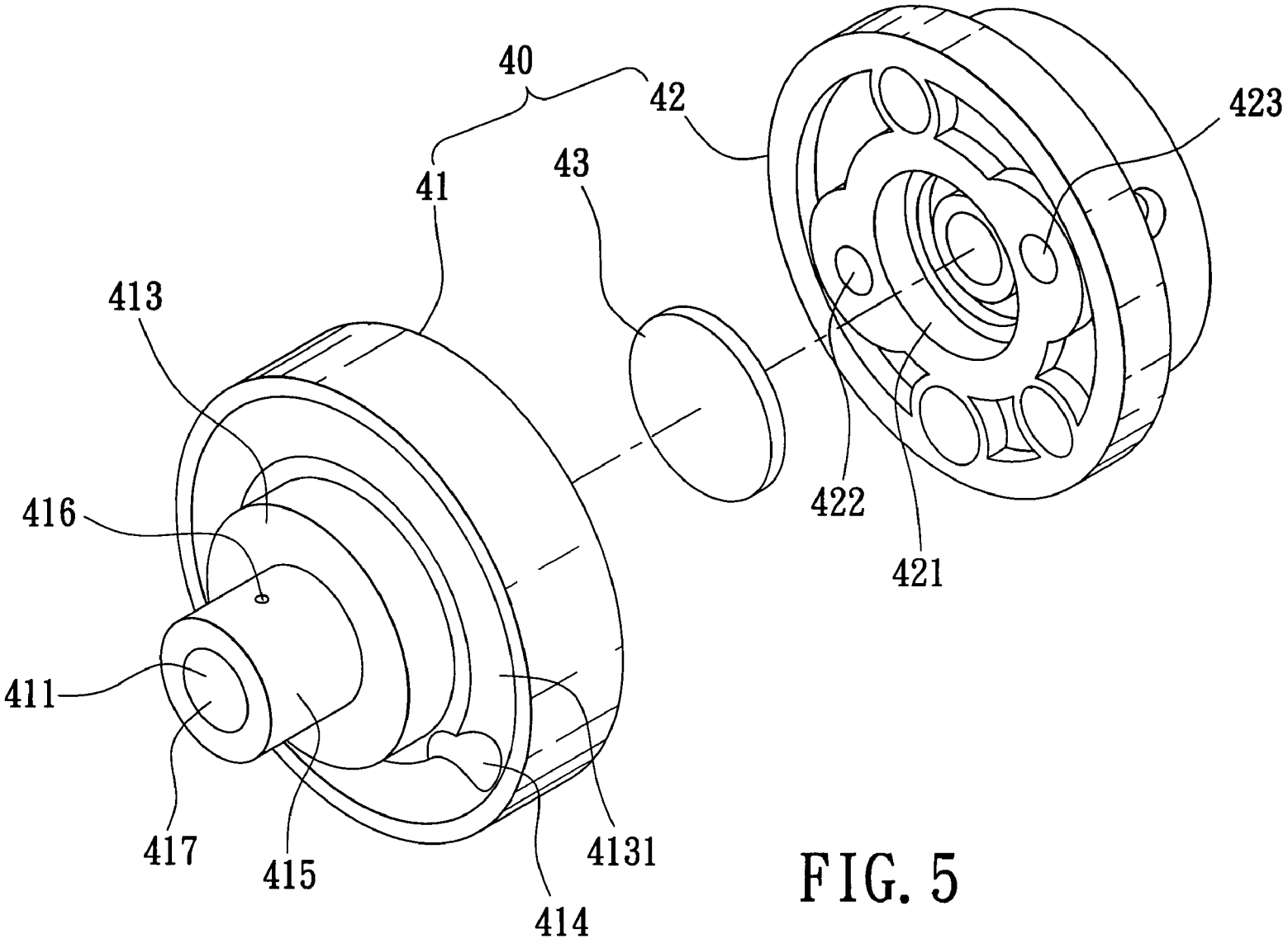
FIG. 5 is an enlarged exploded perspective view of an air valve of the first preferred embodiment.
Figure 6:
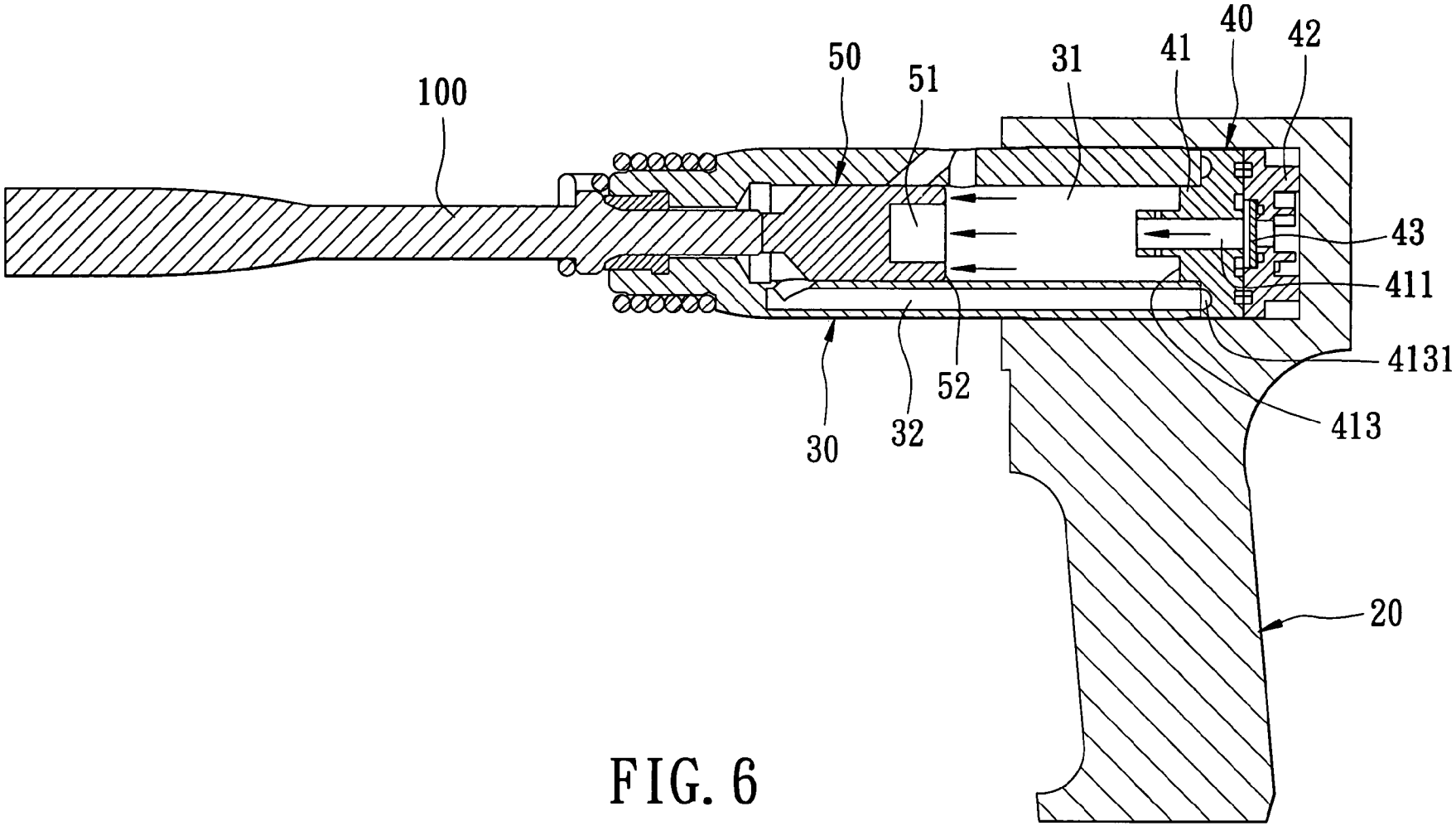
FIG. 6 is a view similar to FIG. 4, but illustrating how a piston is pushed forwardly by compressed air to impact against a tool.
Figure 7:
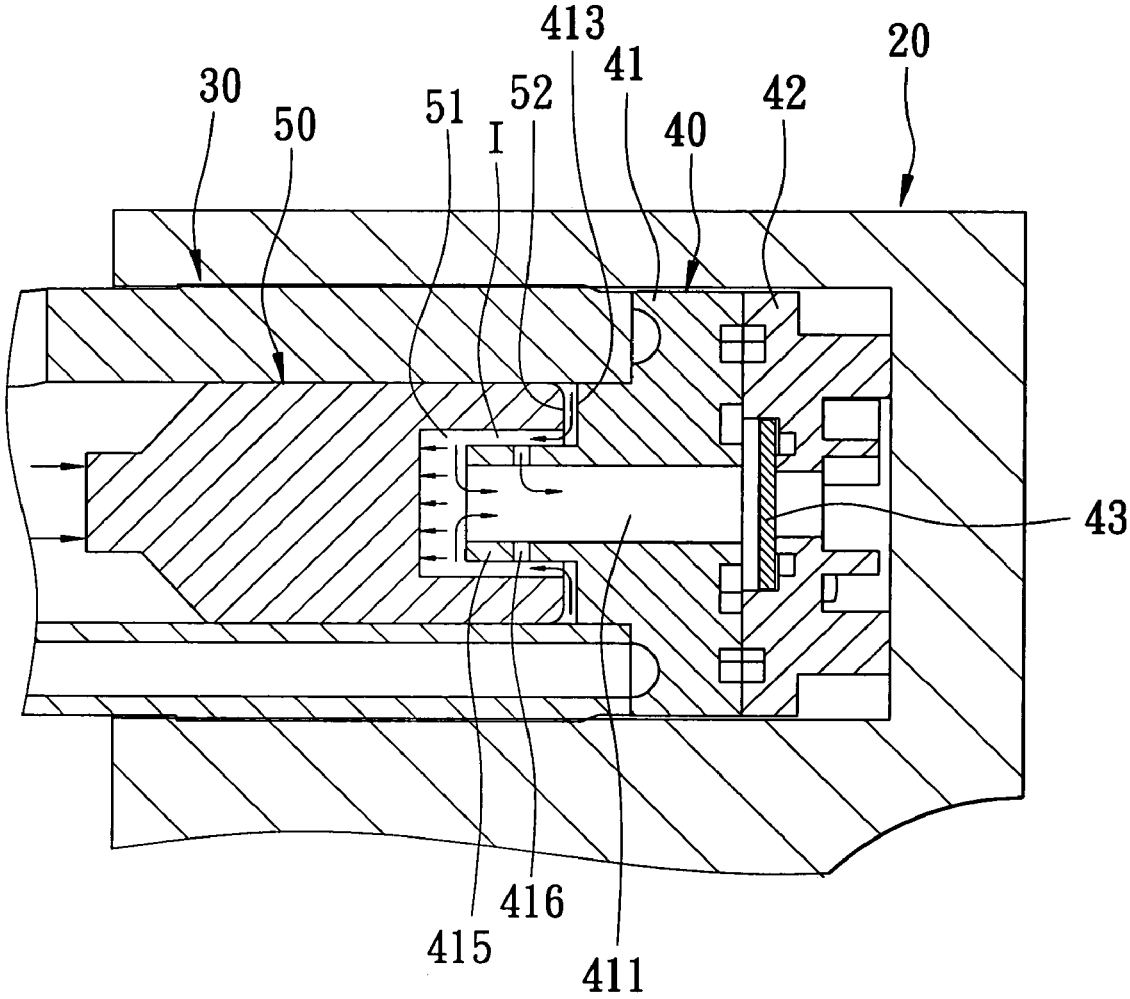
FIG. 7 is an enlarged fragmentary sectional view, illustrating how air is trapped between the piston and a front valve casing of the air valve.

To restore the piston 50 to its original position, as shown in FIG. 4, the compressed air is directed to a front side of the pressure chamber 31 via the air passage 32 so as to push the piston 50 rearwardly toward the front valve casing 41. The piston 50 compresses the air between the piston rear end 52 thereof and the air valve 40 so that the air passes through the valve orifice 411 and flows into the air outlet 423 for exit from the handle body 20.

During rearward movement of the piston 50 toward the front bearing end 413, due to the presence of the protrusion 415, air currents flowing to the front bearing end 413 can be trapped between annular faces of the front bearing end 413, the piston rear end 52, and around the protrusion 415, thus forming an air cushion that can dampen impact of the piston rear end 52 against the front bearing end 413. As the piston rear end 52 abuts against the front bearing end 413, the trapped air may squeeze through the gap (I) and the radial holes 416 in the protrusion 415, and into the valve orifice 411.

From the aforementioned description of the present invention, it is apparent that by providing the pneumatic hammer drill of the present invention with the air trap arrangement, a shock-absorbing air cushion can be provided so as to reduce impact forces between the piston rear end 52 of the piston 50 and the front bearing end 413 of the air valve 40, thereby resolving the problems associated with strong impact forces as encountered in the aforementioned conventional pneumatic hammer drill.

Further, because the front valve casing 41 is provided with the annular groove 4131, the aperture 414 and the air passage 32 can be intercommunicated via the annular groove 4131 without the need to align the aperture 414 and the air passage 32. Therefore, no special alignment between the front valve casing 41 and the piston 30 is required to allow for fluid communication therebetween.

Figure 8:
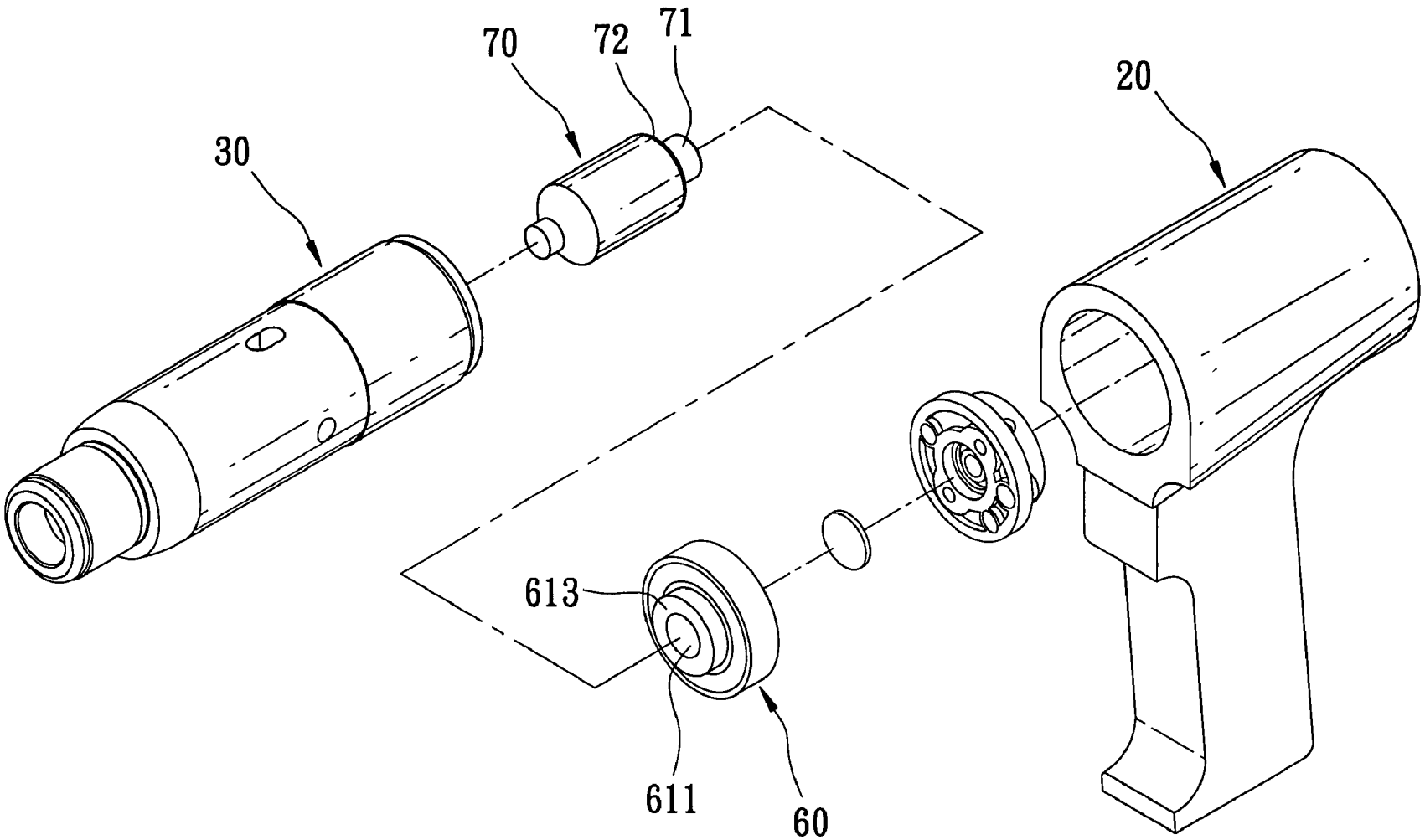
FIG. 8 is an exploded perspective view of the second preferred embodiment of a pneumatic hammer drill according to the present invention.
Figure 9:
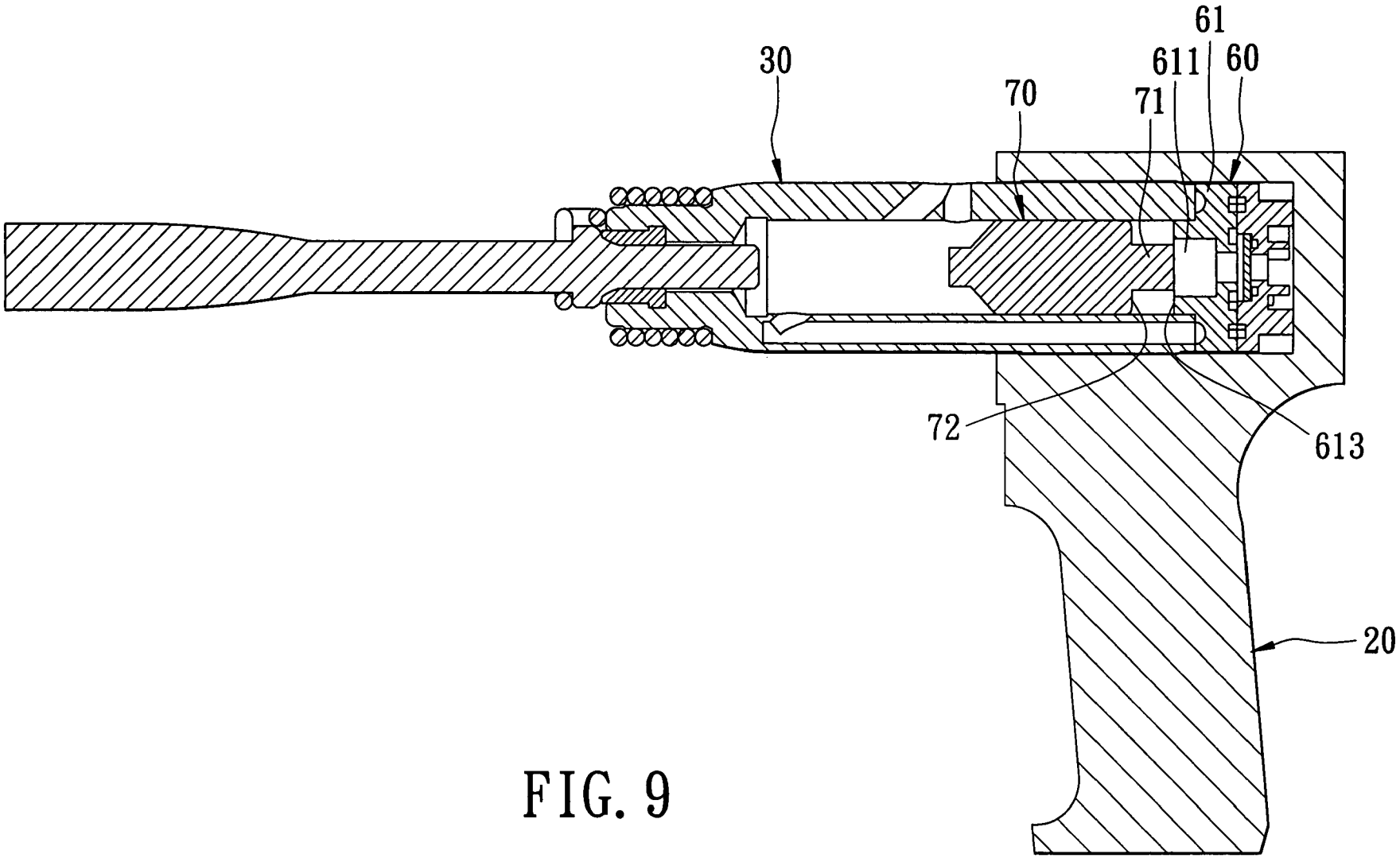
FIG. 9 is an assembled sectional view of the second preferred embodiment.

Referring to FIGS. 8 and 9, the second preferred embodiment of a pneumatic hammer drill according to the present invention is shown to be similar to the first preferred embodiment. However, in this embodiment, the air trap arrangement includes a protrusion 71 formed at the piston rear end 72 of the piston 70, and a cavity 611 formed in the front bearing end 613 of the air valve 60. A damping effect such as that described in the first preferred embodiment can be similarly achieved using the second preferred embodiment.

Figure 10:
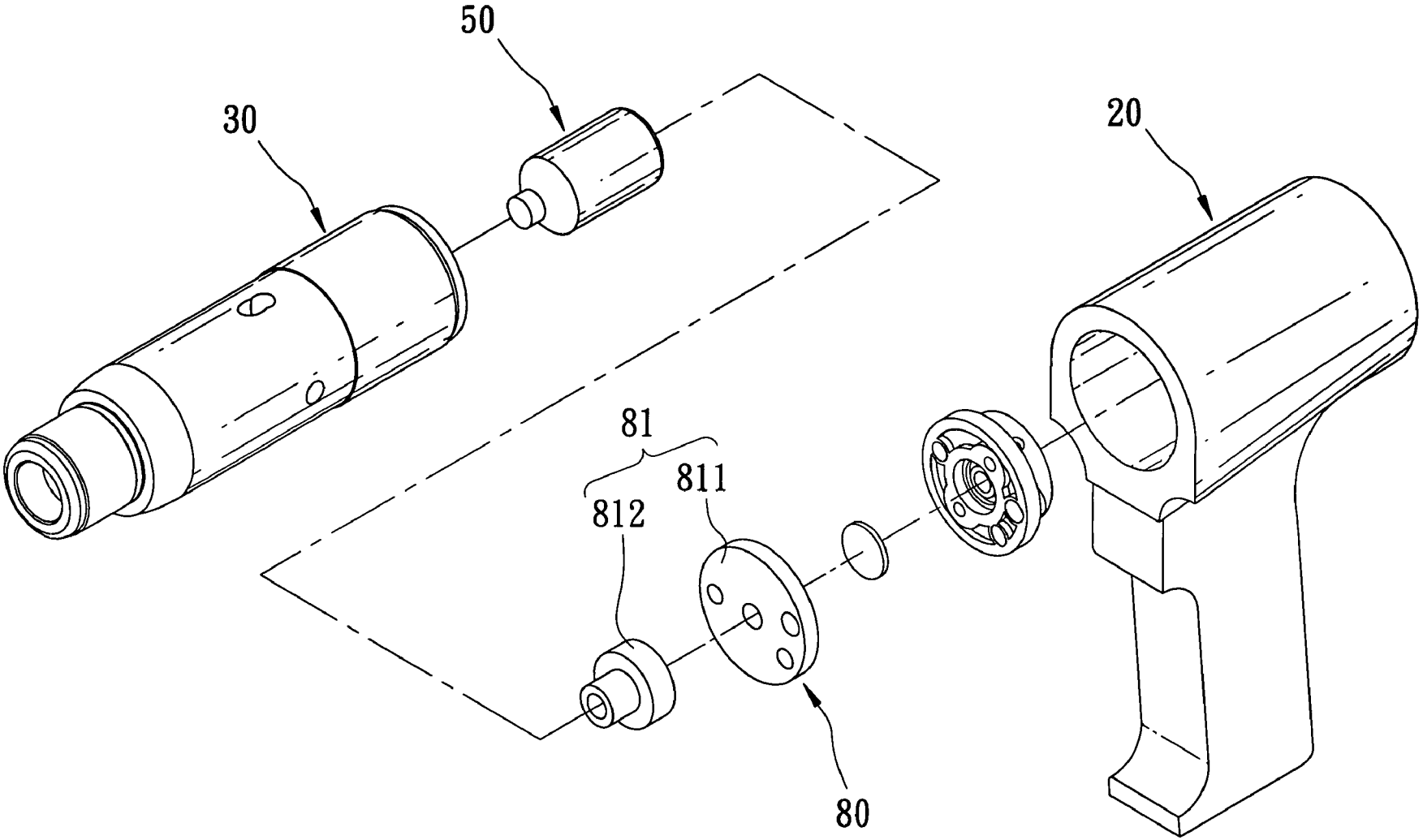
FIG. 10 is an exploded perspective view of the third preferred embodiment of a pneumatic hammer drill according to the present invention.

Referring to FIG. 10, the third preferred embodiment of a pneumatic hammer drill according to the present invention is shown to be similar to the first preferred embodiment. However, in this embodiment, the front valve casing 81 of the air valve 80 is made by assembling a circular plate 811 and a stepped tube 812. The front valve casing 81 as such can be manufactured easily.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A pneumatic hammer drill, comprising:

a handle body;

a pneumatic cylinder having a cylinder rear end fitted in said handle body, a front tool-connecting end, an air passage, and a pressure chamber;

an air valve fitted in said handle body adjacent to said cylinder rear end, and having a front bearing end, a valve orifice interconnecting fluidly said air passage and said pressure chamber, an opening disposed at said front bearing end in communication with said valve orifice, and a diaphragm disposed across said valve orifice;

a piston disposed slidably in said pressure chamber and having a piston rear end capable of moving toward or away from said front bearing end; and an air trap arrangement associated with said piston rear end and said front bearing end to trap air between said piston rear end and said front bearing end and around said opening so as to provide a shock-absorbing air cushion when said piston rear end moves towards said front bearing end, said air trap arrangement including a protrusion formed in one of said front bearing end and said piston rear end, and a cavity formed in the other one of said front bearing end and said piston rear end to receive said protrusion, said protrusion having a cross section smaller than that of said cavity;

said air valve further including front and rear valve casings, said front valve casing being provided with said front bearing end and having an annular groove extending continuously in said front bearing end and around said protrusion and said cavity, and an aperture formed in the groove in front of said valve casing and communicated fluidly with said valve orifice, wherein said aperture is open to said annular groove so as to communicate with said annular groove;

and wherein said air passage has a rear end aligned with a portion of said annular groove and communicated fluidly with said annular groove which fluidly connects said air passage to said aperture.

2. The pneumatic hammer drill of claim 1, wherein said cavity is formed in said piston rear end, and said protrusion is formed in said front bearing end.

3. The pneumatic hammer drill of claim 2, wherein said protrusion has a tubular wall around said valve orifice and formed with two diametrically opposed radial holes in fluid communication with said valve orifice.

4. The pneumatic hammer drill of claim 1, wherein said cavity is formed in said front bearing end, and said protrusion is formed in said piston rear end in alignment with said valve orifice.

* * * * *